US006866095B2

(12) United States Patent
Skeels

(10) Patent No.: US 6,866,095 B2
(45) Date of Patent: Mar. 15, 2005

(54) DOWNHOLE SAFETY VALVE FOR CENTRAL CIRCULATION COMPLETION SYSTEM

(75) Inventor: Harold B. Skeels, Kingwood, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/301,381

(22) Filed: Nov. 21, 2002

(65) Prior Publication Data

US 2004/0099419 A1 May 27, 2004

(51) Int. Cl.[7] ..... E21B 34/10
(52) U.S. Cl. ..... 166/133; 166/188; 166/321
(58) Field of Search ..... 166/133, 188, 166/319, 320, 321

(56) References Cited

U.S. PATENT DOCUMENTS

| | | | | |
|---|---|---|---|---|
| 3,252,476 A | * | 5/1966 | Page, Jr. | 137/458 |
| 3,494,420 A | | 2/1970 | Sizer | |
| 3,897,824 A | * | 8/1975 | Fisher | 166/188 |
| 4,049,052 A | * | 9/1977 | Arendt | 166/183 |
| 4,405,014 A | | 9/1983 | Talafuse | |
| 4,632,184 A | * | 12/1986 | Renfroe et al. | 166/105.5 |
| 4,807,700 A | | 2/1989 | Wilkins | |
| 4,848,457 A | | 7/1989 | Lilley | |
| 4,903,774 A | | 2/1990 | Dykes et al. | |
| 4,958,686 A | | 9/1990 | Putch | |
| 5,040,606 A | | 8/1991 | Hopper | |
| 5,299,640 A | | 4/1994 | Streich et al. | |
| 5,503,230 A | | 4/1996 | Osborne et al. | |
| 5,706,893 A | | 1/1998 | Morgan | |
| 6,145,594 A | | 11/2000 | Jones | |
| 6,345,668 B1 | | 2/2002 | Reilly | |
| 2002/0000322 A1 | | 1/2002 | Bartlett et al. | |
| 2002/0139422 A1 | | 10/2002 | Bartlett | |

FOREIGN PATENT DOCUMENTS

| | | |
|---|---|---|
| EP | 0 331 227 A1 | 9/1989 |
| GB | 2 049 765 A | 12/1980 |
| GB | 2 218 135 A | 11/1989 |
| GB | 2 361 725 A | 10/2001 |
| WO | WO 01/73254 A2 | 10/2001 |
| WO | WO 01/73256 A1 | 10/2001 |

* cited by examiner

*Primary Examiner*—Hoang Dang
(74) *Attorney, Agent, or Firm*—Henry C. Query, Jr.

(57) ABSTRACT

A downhole safety valve for a central circulation completion system having concentric inner and outer tubular members defining a production bore therebetween comprises a generally cylindrical body which includes an outer surface which is sealed to the outer tubular member and an axial through bore to which the inner tubular member is secured. In this manner, the downhole safety valve forms a pressure barrier between a first portion of the production bore located below the body and a second portion of the production bore located above the body. The downhole safety valve further comprises at least one flow passage which extends through the body and communicates between the first and second portions of the production bore, and at least one closure member which is disposed across the flow passage to control fluid flow between the first and second portions of the production bore.

12 Claims, 4 Drawing Sheets

DOWNHOLE SAFETY VALVE FOR CENTRAL CIRCULATION COMPLETION SYSTEM

BACKGROUND OF THE INVENTION

The present invention relates to a downhole safety valve for a central circulation completion system. More particularly, the invention relates to a valve for selectively sealing the annular production bore between the inner tubing string and the outer tubing string in a central circulation completion system.

In traditional subsea completion systems, a tubing string is suspended from a tubing hanger which is landed in a wellhead housing or in a christmas tree that is installed over the wellhead housing. The tubing string extends into the hydrocarbon reservoir and defines a production bore through which well fluids may be produced. In addition, the tubing string is usually positioned within a casing string which is typically suspended from the wellhead housing. The casing string also extends into the reservoir, and the annulus between the tubing string and the casing string defines a service bore through which fluids may be circulated, for example during installation of the completion system.

Subsea completion systems normally comprise at least one downhole safety valve, such as a surface controlled subsea safety valve ("SCSSV"), which functions to close off the production bore in the event of an emergency. A typical prior art SCSSV comprises a ball valve which is disposed in a cylindrical housing that is mounted within or between successive sections of the tubing string. The ball valve is held in the open position by hydraulic control pressure but is biased toward the closed position by a spring or the like. Accordingly, if a need to close off the production bore arises, the hydraulic pressure is relieved, thus allowing the valve to close.

In central circulation completion systems, examples of which are described in International Publication Number WO 01/81710 A1, which is hereby incorporated herein by reference, the roles of the production and service bores are largely reversed. Thus, in such systems the inner tubing string defines a service bore which may be used to circulate fluids during installation and workover operations. In addition, the annulus between the inner tubing string and a second, outer tubing string defines a production bore through which well fluids are produced.

As with traditional subsea completion systems, central circulation completion systems must also be provided with means to shut off the production bore in the event of an emergency. However, since most downhole safety valves are designed to be used with conventional completion systems, wherein well fluids are communicated through the inner tubing string, they generally cannot be used with central circulation completion systems.

SUMMARY OF THE INVENTION

In accordance with the present invention, these and other limitations in the prior art are overcome by providing a downhole safety valve for a central circulation completion system comprising an inner tubing string which extends through an outer tubing string and a production bore which is defined between the inner and outer tubing strings. The downhole safety valve comprises a generally cylindrical body which includes an outer surface and a through bore that extends generally axially through the body, a mechanism for securing the body to the inner tubing string, and at least one seal for sealing the body to the outer tubing string. In this manner, the body forms a pressure barrier between a first portion of the production bore located below the body and a second portion of the production bore located above the body. The downhole safety valve also comprises at least one flow passage which extends through the body and communicates between the first and second portions of the production bore, and at least one closure member which is disposed across the flow passage. Thus, fluid flow between the first and second portions of the production bore is controlled by the closure member.

In accordance with one embodiment of the invention, the closure member comprises a gate valve which includes a gate that is movable across the flow passage. In addition, the gate valve includes an actuating mechanism for moving the gate between a closed position in which a hole in the gate is offset from the flow passage and an open position in which the hole is aligned with the flow passage. The actuating mechanism comprises a piston which is connected to the gate and which is responsive to a predetermined amount of hydraulic pressure to move the gate from the closed position to the open position. The actuating mechanism also comprises a return biasing mechanism which forces the gate from the open position to the closed position in the absence of the predetermined amount of hydraulic pressure.

Thus, the downhole safety valve of the present invention forms an effective pressure barrier for the annulus-shaped production bore of the central circulation completion system. In addition, the safety valve permits well fluids to flow through the production bore only when a predetermined amount of hydraulic pressure is applied to the actuating mechanism. In the absence of this hydraulic pressure, the return biasing mechanism will close the safety valve and thereby close off the production bore.

These and other objects and advantages of the present invention will be made apparent from the following detailed description, with reference to the accompanying drawings.

DETAILED DESCRIPTION OF THE PREFERRED EMBODIMENTS

Figure 1A:
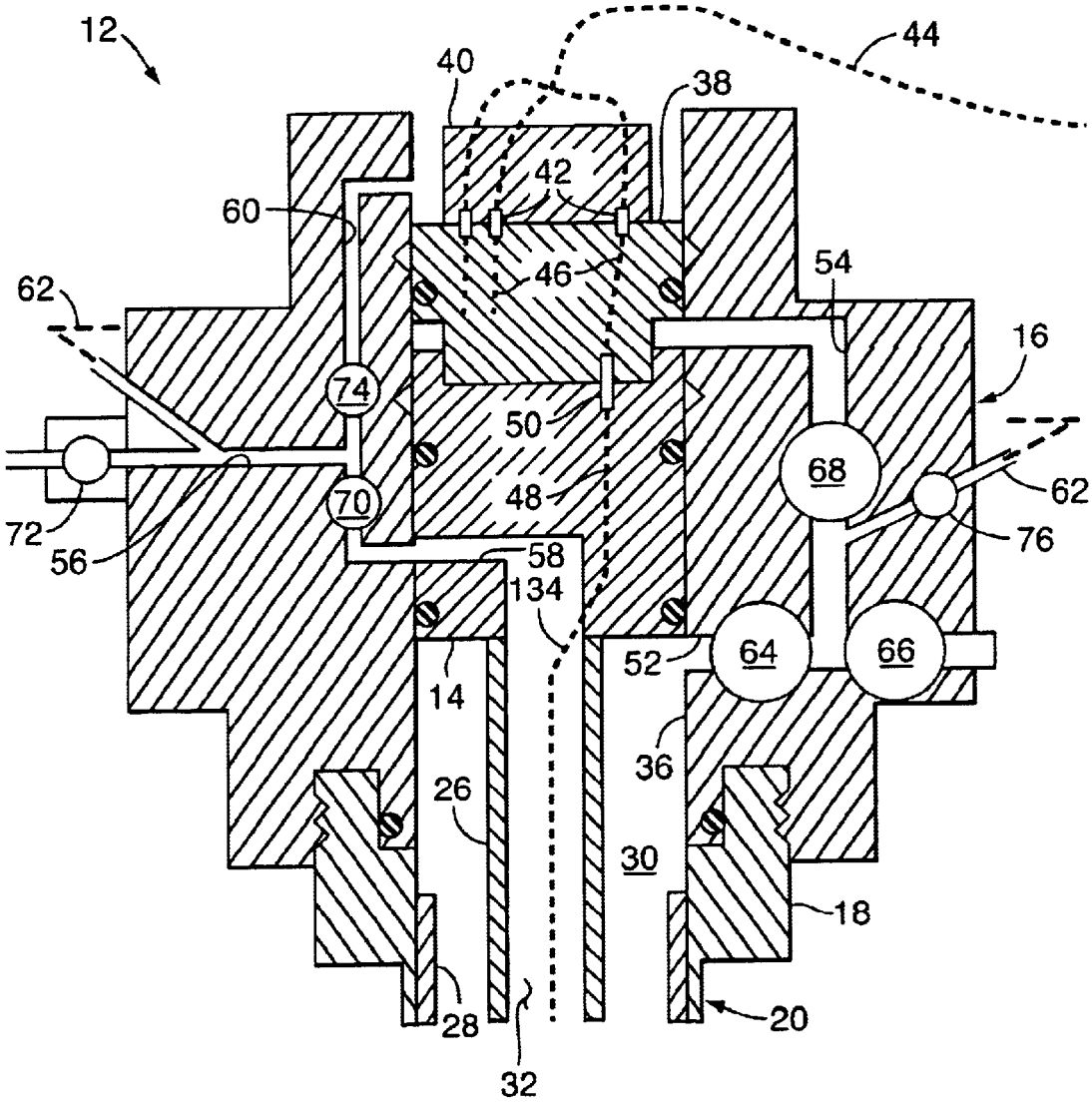
FIG. 1A is a representation of the top portion of an exemplary central circulation completion system, showing a tubing hanger landed in a christmas tree which is installed on a wellhead housing.
Figure 1B:
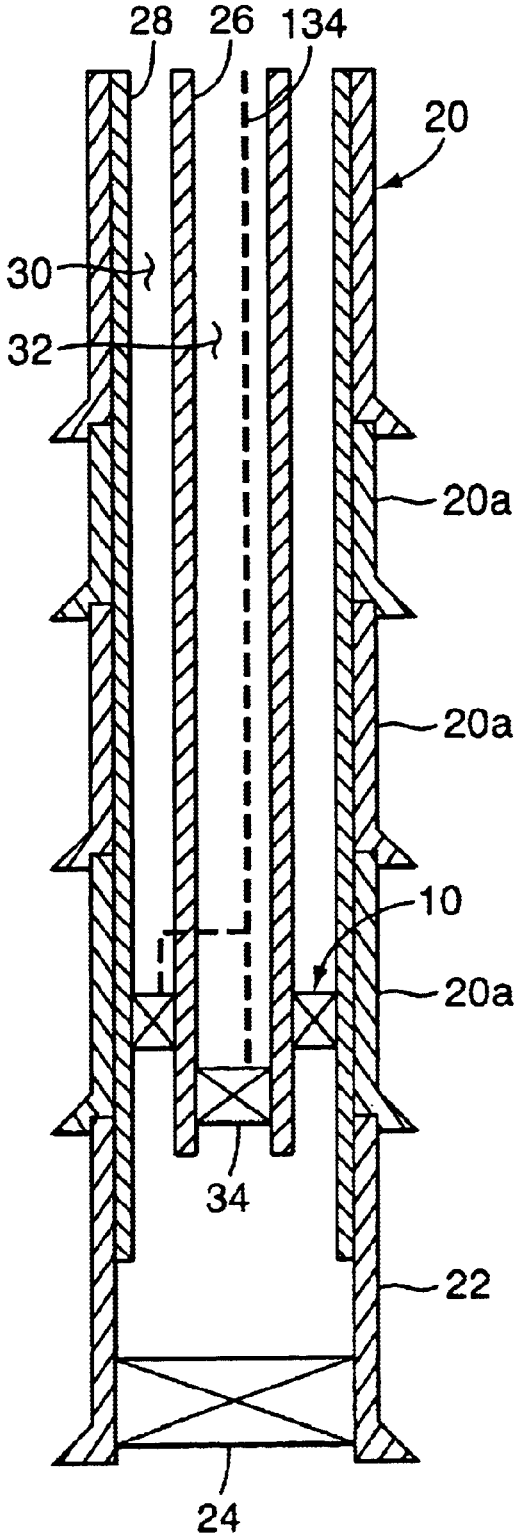
FIG. 1B is a representation of the bottom portion of the central circulation completion system of FIG. 1A.

Referring to FIGS. 1A and 1B, the downhole safety valve of the present invention, generally 10, is shown installed in an exemplary central circulation completion system 12. As described in the aforementioned International Publication Number WO 01/81710 A1, a central circulation completion system can take many forms. In the embodiment shown in FIGS. 1A and 1B, for example, the central circulation completion system 12 comprises a tubing hanger 14 which is supported in a christmas tree 16 that is installed on a wellhead housing 18. The wellhead housing 18 in turn is mounted to the top of a casing string 20 which extends into the hydrocarbon reservoir. The casing string 20 may comprise a number of sections of expandable casing 20*a*, each of which is successively installed using conventional methods. In addition, a liner section 22 comprising a liner top isolation valve 24 may be installed below the lowermost section of expandable casing 20*a*.

The exemplary central circulation completion system 12 also comprises an inner tubing string 26, which is suspended from the tubing hanger 14 and extends approximately to the bottom of the casing string 20, and an outer tubing string 28, which is run in through the wellhead housing 18 and expanded into sealing engagement with the liner section 22, the casing string 20 and the wellhead housing in a known manner. In this fashion, a production bore 30 is formed between the inner and outer tubing strings 26, 28, and a service bore 32 is formed within the inner tubing string. The production bore 30 is used to communicate well fluids from the reservoir to the christmas tree 16 during the production mode of operation, and the service bore 32 is used to circulate fluids between the tubing hanger 14 and the reservoir during installation and well servicing operations. If required, a remotely actuatable service isolation valve 34 may be installed in the bottom of the inner tubing string 26 to prevent well fluids from entering the service bore 32 during the production mode of operation.

As shown in FIG. 1A, the christmas tree 16 comprises a central bore 36 which communicates with the production bore 30. Also, the tubing hanger 14 is sealed within the central bore 36 to form a pressure barrier between the production bore 30 and the environment. If required or desired, a tree cap 38 may be installed in the central bore 36 above the tubing hanger 14, and a controls cap 40 comprising a number of remote wet-mate couplers 42 may be removably secured to the tree cap 38 to provide an interface between an external jumper 44 and a number of service and control lines 46 in the tree cap. At least one of these service and control lines 46 is preferably connected with a corresponding service and control conduit 48 in the tubing hanger 14 via a remote subsea mutable coupler 50 for reasons which will be described below.

The christmas tree 16 also includes a number of conduits to effect the production of the well fluids and to facilitate the servicing of the well. For example, the christmas tree 16 may comprise a production conduit 52 which communicates with the production bore 30, a production bypass conduit 54 which extends between the production conduit and a portion of the central bore 36 located above the tubing hanger 14, a service conduit 56 which communicates with a service outlet 58 in the tubing hanger 14 that in turn is connected with the service bore 32, a workover conduit 60 which extends between the service conduit and a portion of the central bore located above the tubing hanger or the tree cap 38, and a crossover conduit 62 which is connected between the production conduit and the service conduit. The christmas tree 16 typically also includes a number of valves to control the flow of fluids through these conduits. Thus, the christmas tree 16 may comprise a production master valve 64 and a production wing valve 66 in the production conduit 52, a production bypass valve 68 in the production bypass conduit 54, a service master valve 70 and a service wing valve 72 in the service conduit 56, a workover valve 74 in the workover conduit 60, and a crossover valve 76 in the crossover conduit 62. These valves are normally manually or hydraulically actuatable gate valves or the like.

Figure 2:
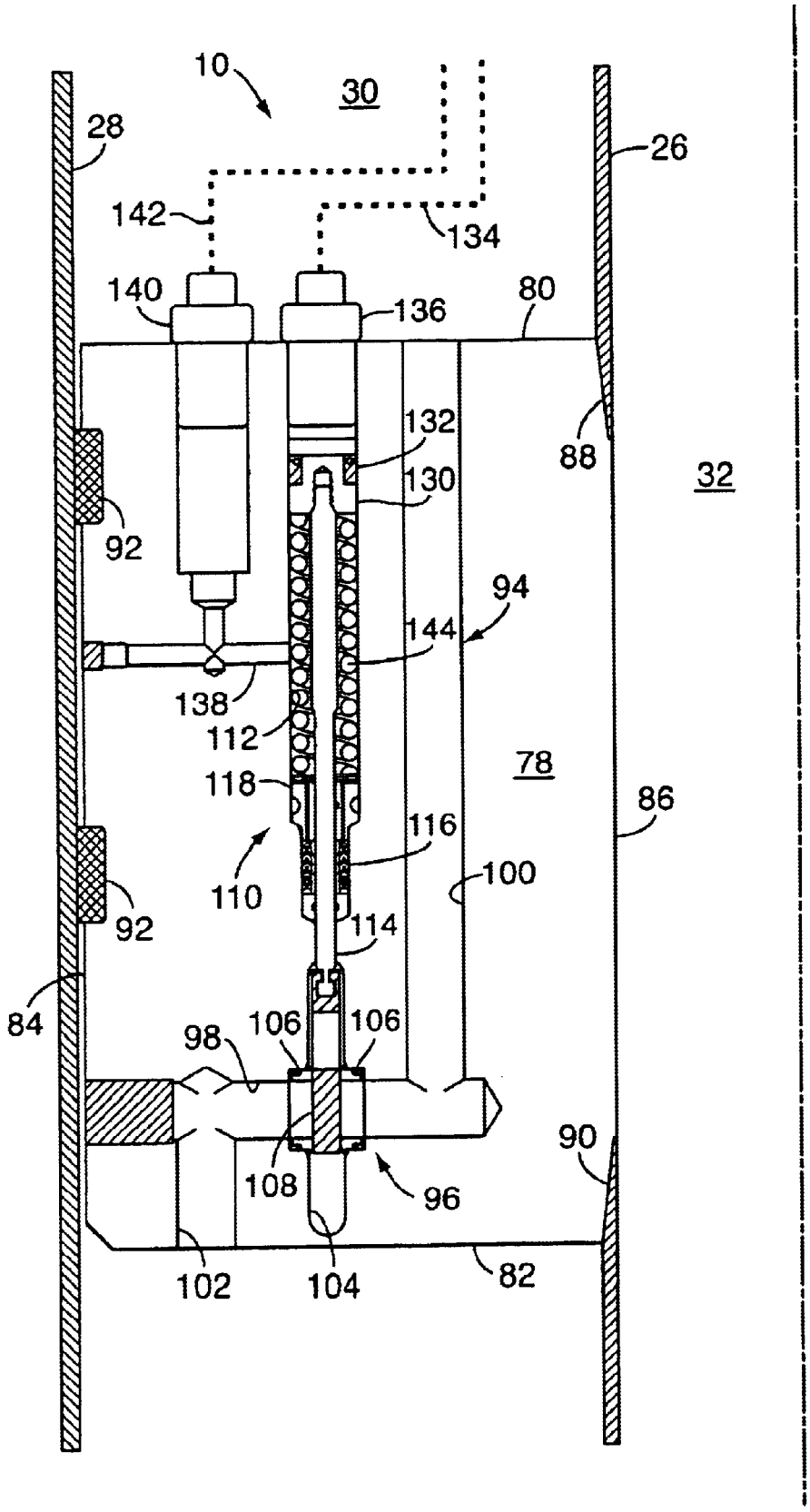
FIG. 2 is a left half cross sectional view of the safety valve of the present invention shown installed between an inner tubing string and an outer tubing string.

In accordance with the present invention, the safety valve 10 is positioned between the inner and outer tubing strings 26, 28 to control the flow of well fluids through the production bore 30, for example, to seal off the production bore in the event of an emergency. Referring to FIG. 2, the safety valve 10 comprises a generally cylindrical body 78 which has a top surface 80, a bottom surface 82, an outer surface 84 and an annular through bore 86 that extends between the top and bottom surfaces. The diameter of the outer surface 84 is sized to be slightly smaller than the diameter of the outer tubing string 28, and the diameter of the through bore 86 is preferably selected to be approximately the same as the diameter of the inner tubing string 26. In this manner, the body 78 will substantially fill the annular void between the inner and outer tubing strings 26, 28.

In a preferred embodiment of the invention, the safety valve 10 is deployed with the inner tubing string 26 and is therefore secured and sealed to the inner tubing string prior to being lowered into the production bore 30. For example, successive sections of the inner tubing string 26 may be threaded into upper and lower threaded receptacles 88 and 90 which are formed in the through bore 86. Alternatively, the body 78 may be secured to the inner tubing string 26 using one or more conventional mechanical fasteners (not shown). Depending on the mode of attachment of the safety valve 10 to the inner tubing string 26, one or more conventional seals (not shown) may be provided to seal the body 78 to the inner tubing string.

The safety valve 10 also includes suitable means to seal the body 78 to the outer tubing string 28. In the illustrative embodiment of the invention shown in FIG. 2, a number of annular seals 92 are mounted on the outer surface 84 and sealingly engage the outer tubing string 28 when the safety valve 10 is positioned as desired in the well bore 30. The seals 92 each may comprise any conventional face-type seal which is made from any suitable metallic, elastomeric or non-metallic material, depending on the expected pressures and fluids in the production bore 30. Alternatively, one or more of the seals 92 may comprise a radially energized seal which is expanded into sealing engagement by the pressure in the production bore 30 or by an energizing mechanism (not shown). Also, one seal 92 could comprise a separate packoff which is installed between the body 78 and the outer tubing string 28 once the safety valve 10 is positioned in the production bore 30. Once the seals 92 are engaged against the outer tubing string 28, the body 78 will form a pressure containing barrier between the reservoir and the portion of the production bore 30 located above the safety valve 10.

Referring still to FIG. 2, the safety valve 10 also comprises at least one flow passage 94 which extends generally axially through the body 78, and a closure member 96 which is operable to selectively open and close the flow passage. In a preferred embodiment of the invention, the closure member 96 is oriented longitudinally within the body 78 so as to occupy a minimum of the radial cross sectional area of the body. Accordingly, the flow passage 94 ideally includes at least one transverse branch across which the closure member 96 can operate. In the embodiment of the invention shown in FIG. 2, for example, the flow passage 94 includes a transverse branch 98, an upper axial branch 100 which extends between the transverse branch and the top surface 80 and a lower axial branch 102 which extends between the transverse branch and the bottom surface 82. Of course, the flow passage 94 could have many different configurations, as long as it communicates between the portions of the production bore 30 which are located above and below the body 78.

In a preferred embodiment of the invention, the closure member 96 is a hydraulically operated gate valve such as is described in U.S. Pat. No. 6,497,277, which is commonly owned herewith and is hereby incorporated herein by reference. As shown in FIG. 2, the gate valve 96 comprises a gate cavity 104 which extends generally axially through the body 78 across the transverse branch 98, a pair of ring-shaped seats 106 which are positioned on opposite sides of the gate cavity, and a gate 108 which is disposed between the seats. The gate valve 96 also includes an actuating mechanism 110 which is positioned in a bore 112 that extends axially through the body 78 above the gate cavity 104. The actuating mechanism 110 is connected to the gate 108 by a valve stem 114, which is ideally sealed to the body 78 by a conventional stem packing 116 that is retained within the bore 112 by a gland nut 118.

Figure 3:
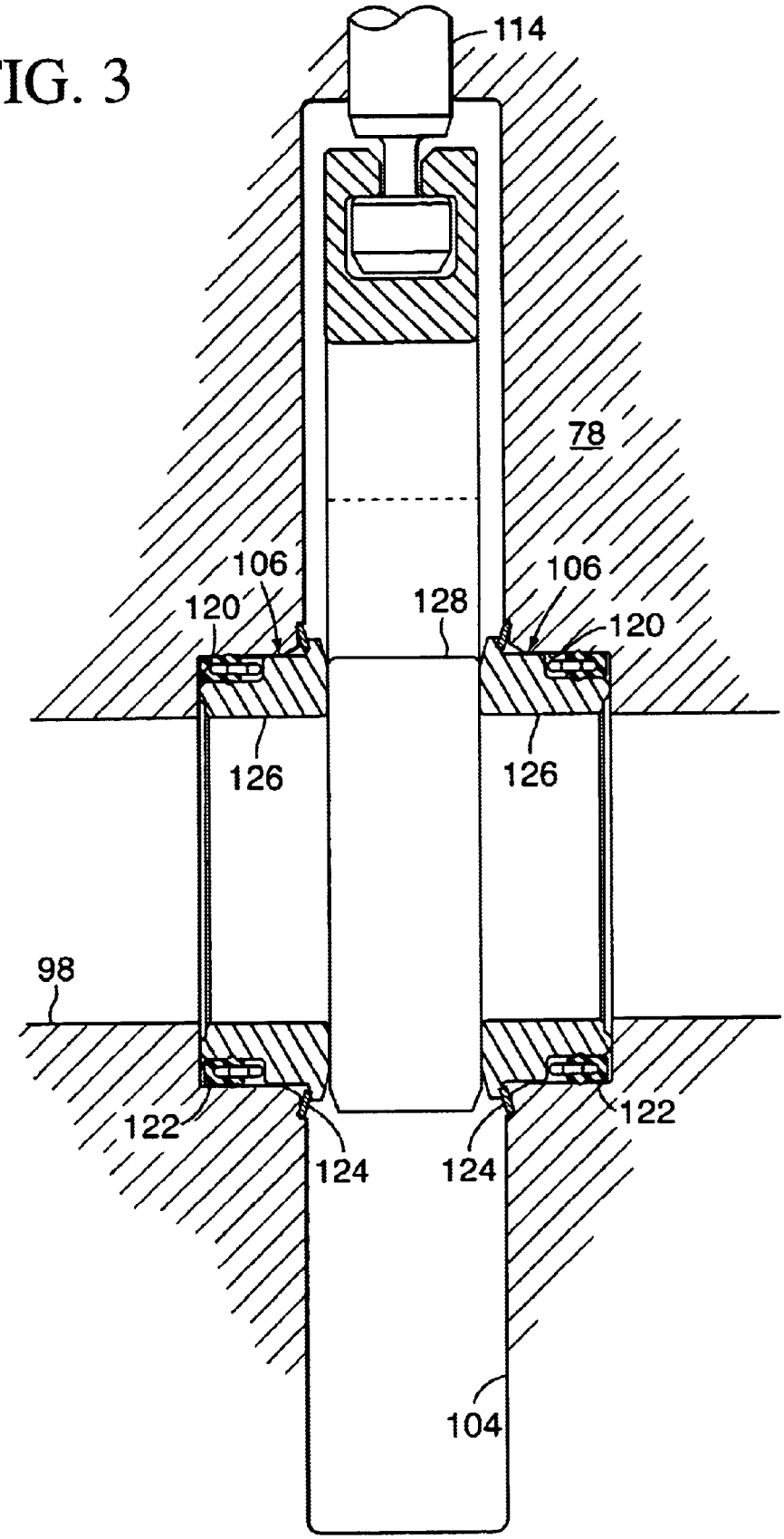
FIG. 3 is an enlarged cross sectional view of the gate and seat portions of the safety valve of FIG. 2.

Referring to FIG. 3, each seat 106 is preferably a floating-type seat which is positioned in a seat pocket 120 that is formed at the intersection of the gate cavity 104 and the transverse branch 98. Each seat 106 is ideally sealed to its corresponding seat pocket 120 by an annular seal 122 and is biased against the gate 108 by a Belleville washer 124. In addition, each seat comprises a coaxial through bore 126 which is aligned with the transverse branch 98.

When the gate valve 96 is in the closed position shown in FIG. 3, a hole 128 which extends transversely through the gate 108 is offset from the through bores 126. In this position, the gate 108 seals against the downstream seat 106 and thereby prevents fluid from flowing through the transverse branch 98. When the gate valve 96 is in the open position (not shown), the hole 128 is aligned with the through bores 126, and fluid is therefore allowed to flow through the transverse branch 98.

Referring again to FIG. 2, the actuating mechanism 110 is preferably operable by hydraulic pressure to move the gate 108 from the closed position to the open position and to hold the gate in the open position until the hydraulic pressure is relieved. In the illustrative embodiment of the invention shown in FIG. 2, the actuating mechanism 110 comprises a piston 130 which is connected to the valve stem 114 and is sealed to the bore 112 by an annular seal 132. Hydraulic pressure is communicated to a portion of the bore 112 located above the piston 130 by a control line 134 which is connected between a suitable fitting 136 in the top of the bore and, for example, the service and control conduit 48 in the tubing hanger 14 (FIG. 1A). In this example, the service and control conduit 48 is connected to a corresponding service and control line 46 in the controls cap 40, which in turn is connected through the jumper 44 to a source of hydraulic pressure (not shown). The safety valve 10 may also comprise a pressure compensation port 138 which communicates with a portion of the bore 112 located below the piston 130 and is connected to a ballast tank or the like (not shown) via a fitting 140 and a control line 142.

In accordance with the present invention, the actuating mechanism 110 also comprises a return biasing mechanism to force the gate 108 into the closed position in the absence of a predetermined amount of hydraulic pressure above the piston 132. In the illustrative embodiment of the invention shown in FIG. 2, the return biasing mechanism comprises a compression spring 144 which is operatively engaged between the gland nut 118 and the piston 132. The spring 144 is designed to exert a desired upward force on the piston 132. Thus, when the hydraulic pressure above the piston 132 is insufficient to overcome the upward force from the spring 144, the gate 108 will move from the open position to the closed position. Therefore, the safety valve 10 is a "fail close" device.

In operation of the safety valve 10, sufficient hydraulic pressure is communicated to the bore 112 above the piston 130 to force the piston downward against the return force of the spring 144. The downward movement of the piston 130 will push the valve stem 114 downward, which in turn will move the gate 108 from the closed position to the open position. In this position, well fluids are free to flow through the flow passage 94 and up through the production bore 30 to the christmas tree 16. In the event a need arises to close off the production bore 30, the hydraulic pressure above the piston 130 is relieved. This will allow the spring 144 to force the piston 130 upward, which in turn will pull the valve stem 114 upward and thereby move the gate 108 from the open position to the closed position. In this position, well fluids are prevented from flowing through the flow passage 94, and the safety valve 10 therefore forms an effective pressure barrier between the reservoir and the portion of the production bore 30 located above the valve.

Although the closure member 96 is described herein as being a hydraulically operated gate valve, other types of valves may be suitable for use in the safety valve 10. For example, the closure member 96 could comprise any suitable hydraulically or electrically operated gate valve, ball valve, plug valve or flapper valve. Also, the closure member 96 could comprise any of the know variety of storm choke valves. Therefore, the present invention should not be limited to any particular closure member 96.

Also, although the safety valve 10 has been described in the context of the exemplary central circulation completion system 12, the safety valve can be used in virtually any completion system in which the well fluids are produced through the annulus between two concentric tubular members. For example, the safety valve 10 can be used in a more traditional type completion system in which a production tubing string is suspended within a production casing string and the well fluids are produced through the annulus between the production tubing and production casing strings. Therefore, the present invention should not be limited by the particular completion system in which the safety valve 10 is employed.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. In combination with a central circulation completion system which comprises an inner tubular member that extends through an outer tubular member and a production bore which is defined between the inner and outer tubular members, a downhole safety valve which comprises:

a generally cylindrical body which includes an outer surface and a through bore that extends generally axially through the body;

means for securing the body to the inner tubular member;

means for sealing the body to the outer tubular member;

wherein the body forms a pressure barrier between a first portion of the production bore located below the body and a second portion of the production bore located above the body;

at least one flow passage which extends through the body and communicates between the first and second portions of the production bore; and at least one closure member which is disposed across the flow passage;

wherein fluid flow between the first and second portions of the production bore is controlled by the closure member.

2. The downhole safety valve of claim 1, wherein the inner tubular member comprises at least first and second successive sections, the securing means comprises first and second receptacles which are aligned with the through bore, and the first and second sections are connected to corresponding ones of the first and second receptacles.

3. The downhole safety valve of claim 1, wherein the inner tubular member comprises at least first and second successive sections, the securing means comprises first and second threaded receptacles which are aligned with the through bore, and the first and second sections are threadedly connected to corresponding ones of the first and second receptacles.

4. The downhole safety valve of claim 1, wherein the sealing means comprises at least one annular face seal which is mounted on the outer surface.

5. The downhole safety valve of claim 1, wherein the closure member comprises a gate valve which includes a gate that is movable across the flow passage.

6. The downhole safety valve of claim 5, wherein the flow passage comprises a transverse branch which is connected to an axial branch, the gate valve comprises a gate cavity which extends through the body across the transverse branch, and the gate is disposed in the gate cavity.

7. The downhole safety valve of claim 5, wherein the gate is disposed between a pair of seats which each comprise a through bore that aligns with the flow passage.

8. The downhole safety valve of claim 5, wherein the gate valve further comprises means for moving the gate between a closed position in which a hole in the gate is offset from the flow passage and an open position in which the hole is aligned with the flow passage.

9. The downhole safety valve of claim 8, wherein the moving means comprises a piston which is connected to the gate and which is responsive to a predetermined amount of hydraulic pressure to move the gate from the closed position to the open position.

10. The downhole safety valve of claim 9, wherein the piston is movable within a conduit that extends generally axially through the body.

11. The downhole safety valve of claim 9, wherein the moving means further comprises a return biasing mechanism which forces the gate from the open position to the closed position in the absence of the predetermined amount of hydraulic pressure.

12. The downhole safety valve of claim 11, wherein the return biasing mechanism comprises a compression spring which is operatively engaged between the piston and the body.

* * * * *